United States Patent [19]

Crawford

[11] 4,021,954

[45] May 10, 1977

[54] TELESCOPIC SIGHT MOUNT

[76] Inventor: Howard E. Crawford, 23107 Cherry Hill, Dearborn, Mich. 48124

[22] Filed: Jan. 26, 1976

[21] Appl. No.: 652,564

[52] U.S. Cl. ..... 42/1 ST; 33/250
[51] Int. Cl.[2] ..... F41G 1/38
[58] Field of Search ..... 42/1 S, 1 ST; 33/245, 33/247, 250

[56] References Cited

UNITED STATES PATENTS

| | | | |
|---|---|---|---|
| 958,989 | 5/1910 | Bennett | 33/245 |
| 2,449,551 | 9/1948 | Garand | 42/1ST |
| 3,463,430 | 8/1969 | Rubin et al. | 42/1 ST |
| 3,835,565 | 9/1974 | Weast | 42/1 ST |

*Primary Examiner*—Charles T. Jordan
*Attorney, Agent, or Firm*—Gifford, Chandler, Sheridan & Sprinkle

[57] ABSTRACT

A sight mount is provided for securing a telescopic sight to the barrel of a rifle. The sight mount comprises a bracket which clampingly engages the rifle barrel and includes an upper portion having a tongue members which extend parallel to but spaced from the axis of the rifle barrel. A sight adapter is provided to secure the telescopic sight to the bracket and includes elongated channel members which cooperate with the tongue members formed on the upper portion of the bracket so that the telescopic sight may be axially positioned along the rifle barrel. Threaded fasteners provide a means whereby the width between the grooves in the sight adapter may be adjusted so that when proper axial position of the telescopic sight is obtained, tightening the threaded members clamps the sight adapter onto the bracket and compressibly locks the tongue and groove members together thereby prohibiting further axial movement of the sight adapter, and hence the telescopic sight, relative to the rifle barrel.

11 Claims, 7 Drawing Figures

TELESCOPIC SIGHT MOUNT

BACKGROUND OF THE INVENTION

I. Field of the Invention

The invention relates to a sight mount, and more particularly, to a sight mount adapted to clamp onto the barrel of a rifle and having means whereby the axial position of the telescopic sight may be selectively positioned and locked into place.

II. Description of the Prior Art

The use of telescopic sights for increased shooting accuracy has become increasingly prevalent in modern times for rifles and the like. Accordingly, a number of previously known sight mounts have been devised for securing a telescopic sight to the rifle. These previously known sight mounts, however, suffer several disadvantages overcome by the sight mount of the present invention.

One disadvantage of the previously known sight mounts is that they are conventionally designed to be secured to the rifle above the firing and ejection mechanisms. This position for the telescopic sight and sight mount oftentimes interferes with the shell ejection mechanism of the rifle. In particular ejected shells have been known to strike the telescopic sight secured to the rifle by such sight mounts and to bounce back into the ejection mechanism and cause the rifle to jam.

Other sight mounts have been devised in which the mount is secured directly to the rifle barrel by screws or the like. Such a mounting arrangement is disadvantageous in that it not only alters the rifle barrel but such an alteration tends to weaken the gun barrel at the attachment point of the sight mount. In addition, these previously known sight mounts are costly to manufacture.

A still further disadvantage of the previously known sight mounts for telescopic sights is that once secured to the rifle, the sight cannot be axially adjusted relative to the gun barrel. Axial adjustment of the telescopic sight along the gun barrel is desirable to accommodate the needs and desires of different shooters who may fire the same rifle.

SUMMARY OF THE PRESENT INVENTION

The telescopic sight mount of the present invention obviates the above-mentioned disadvantages of the previously known sight mounts by providing a sight mount which clamps around the rifle barrel and may be positioned forwardly of the rifle firing and ejection mechanism. In addition, the telescopic sight may be axially adjusted along the rifle barrel and then locked in position to suit the individual needs and desires of the rifle sportsman.

More specifically, the sight mount of the present invention comprises a sight mount bracket which clamps around the rifle barrel and includes an upper portion which extends axially parallel to but spaced from the rifle barrel. A pair of tongue members formed along the bracket upper portion cooperate with a pair of grooves formed in a sight adapter so that the sight adapter is axially adjustable along the barrel due to the sliding engagement of the tongue and groove members. A telescopic sight is secured to the sight adapter and adjusted to the desired axial position along the rifle barrel. When the proper position is obtained, threaded members are rotated to lock the sight adapter, and hence the telescopic sight, against further axial movement.

The sight mount of the present invention thus achieves advantages unknown to the prior art sight mounts. In particular, the clamping engagement of the sight mount bracket to the rifle barrel eliminates the previously known practice of screwing the sight mount to the rifle barrel and the resultant weakened spot in the rifle barrel. Moreover, the sight mount of the present invention may be positioned forwardly of the rifle firing mechanism thus eliminating interference with the rifle shell ejection mechanism. In addition, the axial position of the telescopic sight along the rifle barrel may be easily and simply adjusted and thereafter secured against further movement.

BRIEF DESCRIPTION OF THE DRAWINGS

A better understanding of the sight mount of the present invention will be had upon reference to the following detailed description when read in conjunction with the accompanying drawing wherein like reference characters refer to like parts throughout the several views, and in which.

DETAILED DESCRIPTION OF THE PREFERRED EMBODIMENT

Figure 1:
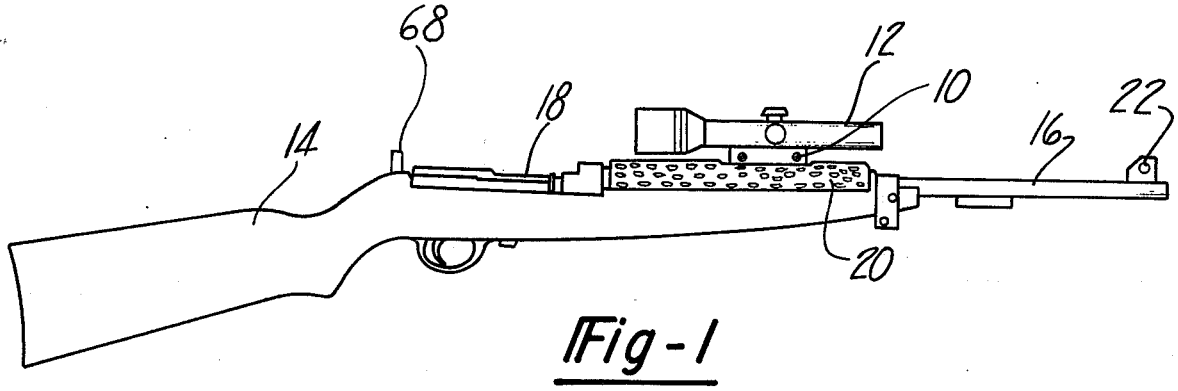
FIG. 1 is a side plan view showing the sight mount of the present invention secured to a rifle.

Referring first to FIG. 1, the sight mount 10 of the present invention is illustrated as securing a telescopic sight 12 to a rifle 14. The rifle 14 further comprises an elongated cylindrical barrel 16, a shell ejection mechanism 18 and a perforated cover plate 20 covering a portion of the barrel 16. Although the rifle 14 may be of any conventional design, in practice it has been found that the sight mount 10 is particularly suited for use in combination with a military M-1 rifle. As can also be seen in FIG. 1, the telescopic sight 12 is mounted forwardly of the ejection mechanism 18. Also, the rifle 14 includes a conventional, non-telescopic, sight 22 at the forward end of the rifle barrel 16, and a rear sight 68 at the rear of the ejection mechanism 18, the use of which will be unaffected by the sight mount 10, as will become hereinafter apparent.

Figure 2:
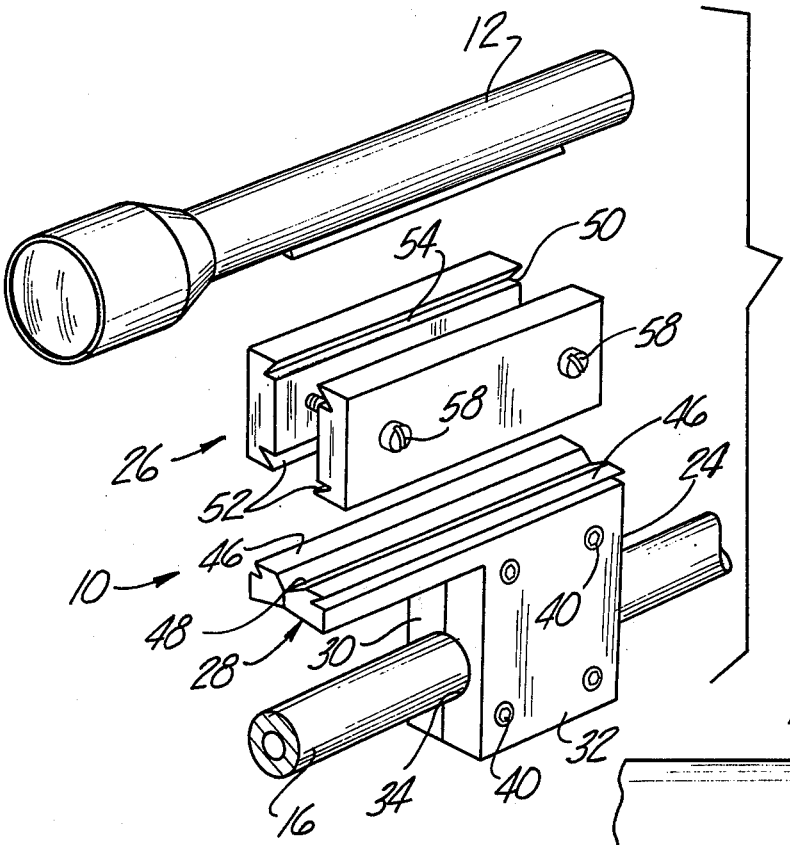
FIG. 2 is an exploded perspective view of the sight mount of the present invention.
Figure 3:
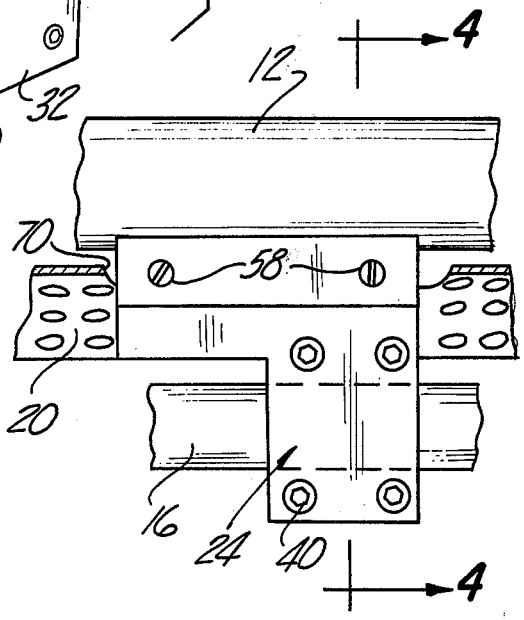
FIG. 3 is a side plan view of the sight mount of the present invention with parts removed and enlarged for clarity.
Figure 4:
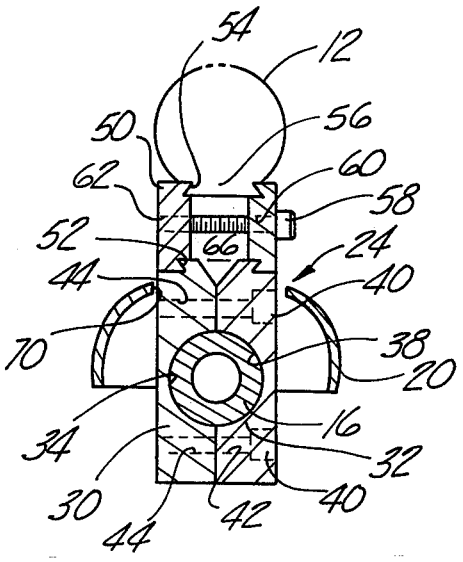
FIG. 4 is a cross-sectional view taken substantially along lines 4—4 in FIG. 3.

Referring now to FIGS. 2–4, the sight mount 10 generally comprises a sight mount bracket 24 secured around the rifle barrel 16 and a sight mount adapter 26 attached at its upper end to the telescopic sight 12 and at its lower end to the upper portion 28 of the bracket 24.

The sight mount bracket 24 comprises a first half section 30 and a second half section 32 which is substantially the mirror image of the first half section 30. A semi-circular channel 34 having a diameter slightly less than the diameter of the rifle barrel 16 is formed longitudinally along one side of the first half section while a similar channel 38 is formed along the second half section 32 so that the channels 34 and 38 both register and face toward each other. Threaded members 40 are received through apertures 42 in the second half section 32 and threadably engage internally threaded bores 44 in the first half section above and below the rifle barrel 16 so that as the threaded members 40 are tightened into the first half section, the bracket 24 becomes rigidly clamped to the rifle barrel 16 with the rifle barrel 16 positioned between the facing semi-circular channels 34 and 38.

The upper portion 28 of the bracket 24 is axially more elongated than the lower bracket portion and includes a pair of spaced and parallel dovetailed tongue members 46. The tongue members 46 extend substantially along the entire length of the bracket upper portion 28 and in addition are in a spaced and parallel relationship to the semi-circular channels 34 and 38, and hence to the rifle barrel 16. The tongue members 46 face outwardly from a central depression 48 formed longitudinally along the upper surface of the bracket upper portion 28.

Still referring to FIGS. 2–4, the sight adapter 26 generally comprises a pair of spaced and parallel plate members 50 which are substantially identical with each other and in a facing relationship relative to each other. Each of the plates 50 includes a dovetailed groove 52 formed longitudinally along its lower surface and of such a cross-sectional shape that each groove 52 receives one tongue member 46 from the bracket 24 therein. It should, therefore, be apparent that the sight adapter 26 may be longitudinally positioned along the upper portion 28 of the bracket 24 due to the sliding engagement between the tongue members 46 and the grooves 52.

A second dovetailed groove 54 is formed longitudinally along the upper portion of each plate member 50 and is of such a cross-sectional shape that the grooves 54 receive a dovetailed mounting tab 56 from the scope 12 therebetween. Like the attachment between the adapter and the bracket, the scope 12 is longitudinally adjustable relative to the adapter 26.

Referring now particularly to FIGS. 2 and 4, bolt members 58 are disposed through transverse apertures 60 in one of the plate members 50 and threadably engage internally threaded bores 62 in the other plate member 50. Consequently, as the bolts 58 are screwed into the threaded apertures 62, the plate members 50 are forced toward each other so that the dovetailed grooves 52 and 54 clampingly engage and compressibly lock the dovetailed tab 56 of the scope 12 and the dovetailed tongue members 46 to the sight adapter 26. In this manner, once the proper axial position of the telescopic sight is obtained relative to the bracket 24, merely tightening the bolts 58 will secure the telescopic sight 12 against further longitudinal movement relative to the rifle.

Figure 5:
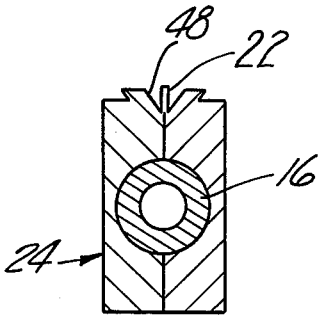
FIG. 5 is a cross-sectional view similar to FIG. 4 but with parts removed and illustrating a modification of the sight mount of the present invention.

The sight mount 10 of the present invention achieves the further advantage that an open channel 66 (FIG. 4) is provided through the center of the adapter 26 so that the manual sight 22 of the rifle 14 may be utilized without removal of the telescopic sight 12. To this end, FIG. 5 illustrates the manual sight 22 centered in the "V" channel 66 so that accurate manual sighting is obtainable. Thus, the sight mount of the present invention provides not only a novel device to mount a telescopic sight to a rifle but also permits the use of the manual sights 68 and 22 without removal of the sight mount 10. In addition, the "V" channel 66 with the front sight 22 provides a highly accurate manual sight if the rear sight 68 is not used.

Figure 6:
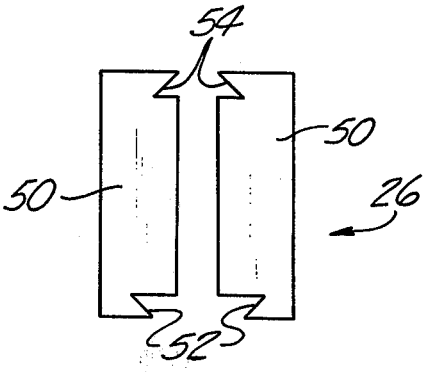
FIG. 6 is a cross-sectional view illustrating the sight adapter of the sight mount of the present invention in a first arrangement.
Figure 7:
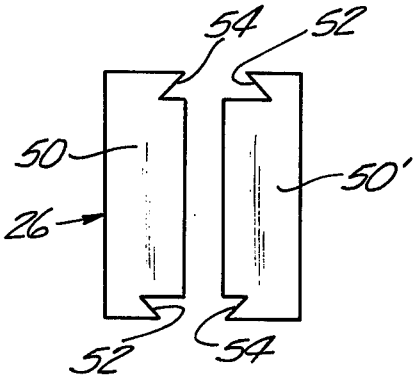
FIG. 7 is a view similar to FIG. 6 but illustrating the sight adapter of the present invention in a second arrangement.

FIGS. 6 and 7 illustrate a still further modification of the present invention which provides increased flexibility for the sight mount 10. More specifically, in FIGS. 6 and 7, the dovetailed grooves 52 and 54 formed along the sight adapter 26 are not of equal width relative to each other. Hence, FIG. 6 illustrates an embodiment in which the dovetailed tab members 46 on the bracket upper portion 28 are transversely wider than the dovetailed tab member 56 on the telescopic sight 12. Accordingly, the transverse width between the grooves 52 is larger than the width between the grooves 54. However, if the transverse width of the tongue members 46 is substantially the same as the width of the dovetailed tab 56 on the telescopic sight 12, as shown in FIG. 7, one plate member 50′ is inverted so that the groove 52 faces the groove 54. With this configuration, the transverse width between the dovetailed grooves on the adapter 26 is the same for both the upper and lower portions of the adapter 26. For this reason, the apertures 60 and 62 through the plate members 50 are formed symetrically so that when one plate member 50′ is inverted, the apertures 60 and 62 still register with each other. This permits the scope mount 10 to be used with sight dovetails of different sizes.

It can thus be seen that the sight mount 10 of the present invention provides substantial advantages over the previously known sight mounts in that the telescopic sight may be easily and quickly longitudinally adjusted along the sight mount 10. Moreover, since the bracket 24 clamps onto the rifle barrel 16, the only necessary modification to the rifle 14 is that an aperture 70 must be cut through the cover plate 20. If preferred the sight mount 10 can be mounted in place without using the cover plate 20 so that cutting an aperture in this member can, if preferred, be eliminated. Moreover, the sight mount 10 is preferably positioned forwardly of the ejection mechanism 18 of the rifle 14 so that the telescopic sight 12 does not interfere with the rifle ejection mechanism. In addition, the sight mount 10 of the present invention permits the rifle sportsman to choose between use of the telescopic sight 12 or the manual sight 22 since the sight mount 10 does not interfere with the manual sight 22.

Having described my invention still further modifications thereto will become apparent to those skilled in the art to which it pertains without deviation from the spirit of the invention as defined by the scope of the appended claims.

I claim:

1. A sight mount for securing a telescopic sight to a barrel of a rifle, said sight mount comprising:

a bracket secured around the barrel of said rifle, said bracket having an upper portion in a spaced apart and parallel relationship to said barrel of said rifle;

a sight adapter comprising a pair of plate members, said sight adapter being axially slidably mounted to said upper portion of said bracket;

first tongue means formed along the upper end of said plate members to lockingly engage said sight; and second tongue means formed along the lower end of said plate members to lockingly engage said bracket.

2. The sight mount as defined in claim 1, wherein said bracket upper portion includes a pair of spaced and parallel axially extending tongue members and wherein said second tongue means comprises spaced and parallel grooves adapted to cooperate with said tongue members so that said tongue members axially slide along said grooves.

3. The sight mount as defined in claim 2 and further comprising at least one threaded fastener transversely disposed between said plate members and threadably engaging one plate member whereby rotation of said fastener in one rotational direction urges said plate members together to compressibly lock said tongue members to said grooves.

4. The sight mount as defined in claim 3, wherein said first tongue means comprises a second groove adapted to cooperate with a tongue member on said telescopic sight so that actuation of said fastener simultaneously compressibly locks said telescopic sight to said adapter and said adapter to said bracket.

5. The sight mount as defined in claim 1, wherein said bracket further comprises a first and second half section, each section having a semi-circular channel of a diameter slightly smaller than the diameter of the rifle barrel formed along one side thereof and adapted to receive said barrel therein, and means to secure said sections together so that said sections clampingly engage said rifle barrel.

6. The sight mount as defined in claim 1 wherein said rifle includes an ejection mechanism and wherein said bracket is secured to said barrel forwardly of said ejection mechanism.

7. A sight mount for securing a telescopic sight to a barrel of a rifle, said sight mount comprising:

a bracket secured around the barrel of said rifle, said bracket having an upper portion in a spaced apart and parallel relationship to said barrel of said rifle, said bracket further comprising a first and second half section, each section having a semicircular channel of a diameter slightly smaller than the diameter of the rifle barrel formed along one side thereof and adapted to receive said barrel therein, and means to secure said sections together so that said sections clampingly engage said rifle barrel;

a sight adapter axially slidably mounted to said upper portion of said bracket and means to lock said sight adapter to said bracket; and means for securing said telescopic sight to said sight adapter.

8. The sight mount as defined in claim 7 and in which said sight adapter is provided with tongue means at its upper end to lockingly engage said sight and tongue means at its lower end to lockingly engage said bracket.

9. The sight mount as defined in claim 8 and in which said sight adapter comprises a pair of plate members, said tongue means being formed on each of said plate members.

10. The sight mount as defined in claim 9 and in which the tongue means at one end of said sight adapter is spaced differently than the tongue means at the other end of said sight adapter and said plate members are formed to permit reversal to thereby cause the tongue means at each end of said sight adapter to be equally spaced.

11. The invention as defined in claim 7 and in which said rifle is provided with a front sight and sighting means aligned with said front sight and an opening formed in said bracket below said telescopic sight.

* * * * *